US008517150B2

(12) United States Patent
Grundmann et al.

(10) Patent No.: US 8,517,150 B2
(45) **Date of Patent: *Aug. 27, 2013**

(54) APPARATUS AND METHOD FOR HOLDING AND BRAKING AN ELEVATOR CAR

(75) Inventors: Steffen Grundmann, Bonstellen (CH); Gert Silberhorn, Merlischachen (CH); Hans Kocher, Udligenswil (CH); Michael Stubi, Bichrain (CH); Georg Halasy-Wimmer, Vaihigrn (DE); Johann Jungbecker, Badenheim (DE); Stefan Johannes Schmitt, Eltville (DE); Bernward Bayer, Rödermark (DE); Andreas Emmerich, Oberursel (DE); Andreas Pohlmann, Hamburg (DE); Karl-Hermann Tegge, Konigstein/Taunus (DE)

(73) Assignee: Inventio AG, Hergiswil (CH)

( * ) Notice: Subject to any disclaimer, the term of this patent is extended or adjusted under 35 U.S.C. 154(b) by 859 days.

This patent is subject to a terminal disclaimer.

(21) Appl. No.: 12/521,211

(22) PCT Filed: Dec. 20, 2007

(86) PCT No.: PCT/CH2007/000645

§ 371 (c)(1), (2), (4) Date: Dec. 9, 2009

(87) PCT Pub. No.: WO2008/080243

PCT Pub. Date: Jul. 10, 2008

(65) Prior Publication Data

US 2010/0089705 A1 Apr. 15, 2010

(30) Foreign Application Priority Data

Jan. 5, 2007 (EP) ..... 07100189

(51) Int. Cl.
*B66B 5/16* (2006.01)
*B66B 1/32* (2006.01)

(52) U.S. Cl.
USPC ..... 187/359; 187/288; 187/351

(58) Field of Classification Search
USPC ..... 187/288, 393, 351, 356, 359, 361, 187/373
See application file for complete search history.

(56) References Cited

U.S. PATENT DOCUMENTS 483,145 A * 9/1892 Giles ..... 187/360
557,117 A * 3/1896 Ellithorpe ..... 187/375

(Continued)

FOREIGN PATENT DOCUMENTS

DE 37 39 654 A1 6/1989
EP 0 440 839 A1 8/1991

(Continued)

*Primary Examiner* — William E Dondero
*Assistant Examiner* — Minh Truong
(74) *Attorney, Agent, or Firm* — Fraser Clemens Martin & Miller LLC; William J. Clemens

(57) ABSTRACT

An elevator car with brake equipment, which is arranged in the region of the elevator car, for holding and braking the same, which brake equipment includes: a brake unit which can co-operate with a brake rail, an actuating device which can produce an actuator force $F_A$, and a connecting linkage which connects the actuating device with the brake unit in force-active manner for transmission of the actuator force $F_A$, wherein the brake unit in unloaded setting is in its open setting and the connecting linkage is a pull cable.

13 Claims, 6 Drawing Sheets

(56) References Cited

U.S. PATENT DOCUMENTS

| | | | | | |
|---|---|---|---|---|---|
| 613,628 | A | * | 11/1898 | Hadfield | 187/375 |
| 621,475 | A | * | 3/1899 | McCormick | 187/379 |
| 805,818 | A | * | 11/1905 | Regina | 187/373 |
| 1,124,804 | A | * | 1/1915 | Remjas | 187/365 |
| 1,129,536 | A | * | 2/1915 | Barash | 187/365 |
| 1,360,653 | A | * | 11/1920 | Liddicoat | 187/372 |
| 1,764,303 | A | * | 6/1930 | Higbee | 187/375 |
| 1,773,869 | A | * | 8/1930 | Schank et al. | 187/370 |
| 1,803,762 | A | * | 5/1931 | Marks | 187/376 |
| 1,937,035 | A | * | 11/1933 | Dunlop | 187/376 |
| 1,971,114 | A | * | 8/1934 | McCormick | 187/375 |
| 2,274,000 | A | * | 2/1942 | Sahlin | 187/376 |
| 2,298,167 | A | * | 10/1942 | Rissler | 187/352 |
| 2,511,697 | A | * | 6/1950 | Clift | 187/375 |
| 2,925,151 | A | * | 2/1960 | Chandler | 187/361 |
| 3,768,597 | A | * | 10/1973 | Darwent et al. | 187/376 |
| 3,942,607 | A | * | 3/1976 | Sobat | 187/373 |
| 4,083,432 | A | * | 4/1978 | Lusti | 187/373 |
| 5,234,079 | A | * | 8/1993 | Nomura | 187/250 |
| 5,321,217 | A | * | 6/1994 | Traktovenko et al. | 187/409 |
| 5,353,895 | A | * | 10/1994 | Camack et al. | 187/369 |
| 5,495,919 | A | * | 3/1996 | Ericson et al. | 187/373 |
| 5,648,644 | A | * | 7/1997 | Nagel | 187/288 |
| 6,032,763 | A | * | 3/2000 | Richter et al. | 187/377 |
| 7,650,969 | B2 | * | 1/2010 | Monzon et al. | 187/300 |
| 7,849,972 | B2 | * | 12/2010 | Higashinaka | 187/351 |
| 2003/0062224 | A1 | * | 4/2003 | Maury et al. | 187/343 |
| 2006/0180406 | A1 | * | 8/2006 | Gremaud et al. | 187/355 |
| 2008/0067011 | A1 | * | 3/2008 | Gremaud et al. | 187/359 |
| 2010/0038184 | A1 | * | 2/2010 | Emmerich et al. | 187/288 |

FOREIGN PATENT DOCUMENTS

| | | | |
|---|---|---|---|
| EP | 0 648 703 | A1 | 4/1995 |
| GB | 1 111 425 | A | 4/1968 |

* cited by examiner

APPARATUS AND METHOD FOR HOLDING AND BRAKING AN ELEVATOR CAR

FIELD OF THE INVENTION

The invention relates to an elevator car with brake equipment, which is arranged in the region of the elevator car, for holding and braking the elevator car, to an elevator installation with at least one such elevator car and to a method for holding and braking such an elevator car.

BACKGROUND OF THE INVENTION

An elevator installation essentially serves for vertical transport of goods or persons. The elevator installation includes for this purpose one or more elevator cars for reception of the goods or persons, which elevator car is movable along a guide track. As a rule the elevator installation is installed in a building and the elevator car transports goods or persons from and to different floors of this building. In a conventional construction the elevator installation is installed in a travel shaft of the building and it includes, apart from the elevator car, support means connecting the elevator car with a counterweight. The elevator car is moved by means of a drive which selectably acts on the support means or directly on the elevator car or the counterweight. The guide track for guidance of the elevator car is usually a guide rail fastened to the building or in the travel shaft. In the case of several elevator cars in one travel shaft each of the elevator cars advantageously has an individual drive system, but the elevator cars advantageously use the same guide track or guide rail. Elevator installations of that kind are equipped with brake systems which can hold the elevator car at a floor stop and/or brake and hold the elevator car in the case of fault. The brake system co-operates with a brake track, which is usually integrated in the guide rail, for the purpose of the braking. Elevator installations of that kind can obviously also be arranged outside the building, wherein then the guide rails can be part of its structure. Conventional safety brake devices are not designed to be able to keep the elevator car in a held position, for example for loading the elevator car, since they can be returned to operation only by a service engineer.

Brake equipment for an elevator car is known from EP 0 648 703, which is arranged in the region of the elevator car and can be used for holding and braking. The brake equipment shown there in that case includes a fluid brake unit which can co-operate with a brake rail, an actuating device which can actuate the brake unit and a connecting means which connects the brake unit with the brake unit in force-active manner. The actuating device is a hydraulic pressure station which is connected with individual brake units by way of hydraulic connecting means and thereby actuates the hydraulic brake units in force-active manner. In this connection "force-active" means that a hydraulic pressure produced in the actuating device actively defines a pressing force, which results in the brake unit, of brake linings against the brake rail. This solution uses hydraulic pressure generators. This is costly and complicated in construction and maintenance. Components of that kind are, in addition, noise-intensive and safety precautions have to be undertaken to limit the effects of leakages.

Currently, car braking equipment is in addition increasingly employed for, for example, holding an elevator car stationary at a floor stop during the loading process or quickly and smoothly correcting faulty behavior of the elevator car.

SUMMARY OF THE INVENTION

The object of the invention now consists in providing brake equipment which can be rapidly brought into use in the event of irregularities in the operation of an elevator car and after use thereof can be rapidly returned to its readiness setting. In that case the equipment shall be low in noise and simple in use.

The invention defined in the independent patent claims fulfils the object.

An elevator car arranged in a travel shaft is equipped with brake equipment for holding and braking the elevator car. The brake equipment consists of a brake unit which with appropriate actuation can co-operate with a brake disc. The brake equipment further includes an actuating device which can produce an actuator force $F_A$ and a connecting means which connects the actuating device in force-active manner with the brake unit for transmission of the actuator force $F_A$. A force-active connection means that the brake unit produces a pressing force $F_N$ and thus a resulting braking force which is defined by a brake coefficient of friction and which is directly dependent on the actuator force $F_A$. A low pressing force $F_N$ thus produces a small braking force and a large actuator force $F_A$ produces a correspondingly large pressing force $F_N$. According to the invention the connecting means is now a pull means and the brake unit is constructed in such a manner that in unloaded setting, i.e. when no actuator force $F_A$ is present, it is in open setting. Open setting means that the brake equipment or the brake unit does not brake. Advantageously a pull cable, a pull rod or a pull chain is used as pull means.

The advantage of this invention resides in the fact that in the case of an irregularity in operation of an elevator car the brake equipment can be brought rapidly into use by way of the mechanical connecting means or the pull means and after use thereof can be rapidly returned to its readiness setting. For that purpose the brake unit is constructed in such a manner that when no actuator force $F_A$ is present it is in open setting and the connecting means is formed by the pull means, since a rapid and safe actuation and also again an easy resetting can thereby take place. Moreover, this equipment is very low in noise, since during operation of the installation there must be no excitation or the like in operation. Furthermore, the equipment is simple in use, since it can be easily checked and understood by an expert. This already results from the circumstance that the principle of this brake equipment has long been known and proven with bicycles.

According to the invention the brake equipment is arranged in the region of the elevator car. Thus, the brake equipment can be used simply for holding the elevator car at a floor or the brake equipment can be braked in the case of unexpected behaviour of the elevator car when, for example, with an opened floor access it suddenly slips away. Thanks to this simple actuation the brake equipment can be reset again in simple manner. The brake disc is as a rule a component of a guide rail along which the elevator car is guided. In addition, the attachment location of the brake equipment is as desired. It can be attached above the elevator car or attached below the elevator car or it can be integrated in the elevator car structure, for example in a car roof, car floor or also in side walls.

Moreover, the elevator car according to the invention is installed in an elevator installation which can include one or more elevator cars of that kind movable in a common travel shaft. In the case of use of several elevator cars of that kind in one travel shaft it is possible, for example, to monitor a spacing of this elevator car from a travel shaft end or from a leading or trailing elevator car with consideration of the travel parameters and to rapidly stop the elevator car concerned in the case of falling below of specific spacings.

In an advantageous embodiment the brake equipment comprises at least two brake units which are advantageously arranged at opposite boundary edges of the elevator car and each of which co-operates with a respective brake rail or guide rail. The actuating device generates an actuator force $F_A$ for actuation of the brake units (9), wherein this actuator force $F_A$ is transmitted substantially symmetrically to the brake units by way of connecting means. Correspondingly, the actuating device is arranged substantially centrally in the middle between two brake units, wherein in each instance a first connecting means is connected with a first brake unit and the second connecting means with a second brake unit.

This embodiment is advantageous, since the holding and braking forces are, due to the arrangement of the brake units at both sides, introduced substantially symmetrically into the elevator car and the actuating device can be arranged centrally, for example in the middle of a roof of the elevator car. Checking is thereby simplified.

Advantageously, a position of the actuating device is defined substantially by an equilibrium of the first and second connecting means. An identical actuator force is thereby given to the two brake units. Moreover, a limiting means is provided which in the case of failure of one of the connecting means limits a lateral displacement of the actuating device and thus maintains the actuator force $F_A$ in the remaining connecting means. This increases the safety of the brake equipment, since notwithstanding failure of one connecting means there is still a residual braking force. If, for example, the braking force of the brake equipment is designed with a safety factor of 2, holding would be guaranteed even in the case of failure of one of the connecting means. The failure of one of the connecting means or contacting of the limiting means by the actuating device can be monitored by a switch and, on detection of this state, maintenance can be initiated or operation of the elevator installation can be restricted.

Advantageously the brake unit includes a force translation which converts the actuator force $F_A$ transmitted by the connecting means into a pressing force $F_N$ and at the same time produces an amplification of this pressing force $F_N$. This is achieved by, for example, a lever mechanism, which converts the actuator force $F_A$ by way of a toggle mechanism, by way of an eccentric or also by way of calotte discs into a pressing force $F_N$. Large force amplifications can be achieved with translation or amplification means of that kind. This is advantageous, since for that reason use can be made of commercially available connecting means such as, for example, a Bowden pull as connecting means.

In a variant of the invention use is made of a tensioning device for generating the actuator force $F_A$ in the actuating device. The tensioning device, when correspondingly controlled, draws the first and second connecting means together in controlled manner or relaxes. This takes place, for example, by way of a spindle drive which draws up or relaxes one or both connecting means relative to the actuating device. The spindle drive is constructed in such a manner that the tensioning device maintains its instantaneously set position in the absence of a control signal or supply energy. The supply energy supplies the drive of the spindle gear or the actuating device with, for preference, electrical energy and the control signal gives the control command to tension the connecting means or to relax the connecting means. The advantages are to be seen in that the braking force determination takes place centrally in the common actuating device and the actuator force is necessarily transmitted with equal effect to the spaced brake units. In addition, it is ensured by the selected tensioning device that a set state is maintained. The actuator force is transmitted substantially by traction. This allows use of advantageous pull means such as, for example, a pull cable, a pull chain or a pull rod.

Advantageously the actuating device includes a sensor for detecting the instantaneous actuator force $F_A$ and this sensor is selectably used for controlling, regulating and monitoring. The sensor is, for example, a force measuring sensor or a spring-loaded position sensor, which detects a compression of the spring, by way of which the actuator force is transmitted, and the position sensor correspondingly represents a measure for the actuator force. In the position sensor, for example, the positions of actuator force are reached or of actuating device are set and the tensioning device is controlled by way of these signals. Actual force or pressure sensors are obviously also usable. The use of a sensor of that kind is advantageous, since a specific traction force can be achieved regardless of a state of wear and, in addition, any deviations can be recognised and correspondingly reported to a service center.

The possibility of suspending the connecting means by a block-and-tackle arises as an advantageous enhancement. The actuator force $F_A$ transmitted by the connecting means to the brake unit can thus be amplified in correspondence with a slinging factor of the block-and-tackle. A holding or braking force required for a specific elevator installation can thus be achieved.

An advantageous embodiment proposes that several elevator cars according to the invention each with respective brake equipment are installed in a common elevator shaft. The items of brake equipment of these elevator cars can be used not only for securing the elevator car at a floor stop, but equally for ensuring a sufficient safety spacing between several elevator cars. This is advantageous, since there can be rapid intervention by the brake equipment if, for example, two elevator cars are to be moved at a small spacing from one another or if a spacing of two elevator cars travelling in succession reduces to an impermissible extent. The brake equipment can be brought into action very quickly or even preventatively and it can be reset equally quickly after elimination of the reason for the disturbance.

The brake equipment can be attached to the elevator car additionally to a safety brake device. This is advantageous, since a known and safety-proven emergency brake system thus protects the elevator car against extreme faults, such as failure of support means, and the task of the brake equipment can be oriented primarily towards faults and/or utilization in the region of stopping points or in the vicinity of limits of the travel path, such as, for example, a travel shaft end or another elevator car.

DESCRIPTION OF THE DRAWINGS

Further refinements are evident from the following examples of embodiment. The invention is explained in more detail by way of an example of embodiment in conjunction with the schematic figures, in which.

DESCRIPTION OF THE PREFERRED EMBODIMENT

Figure 1:
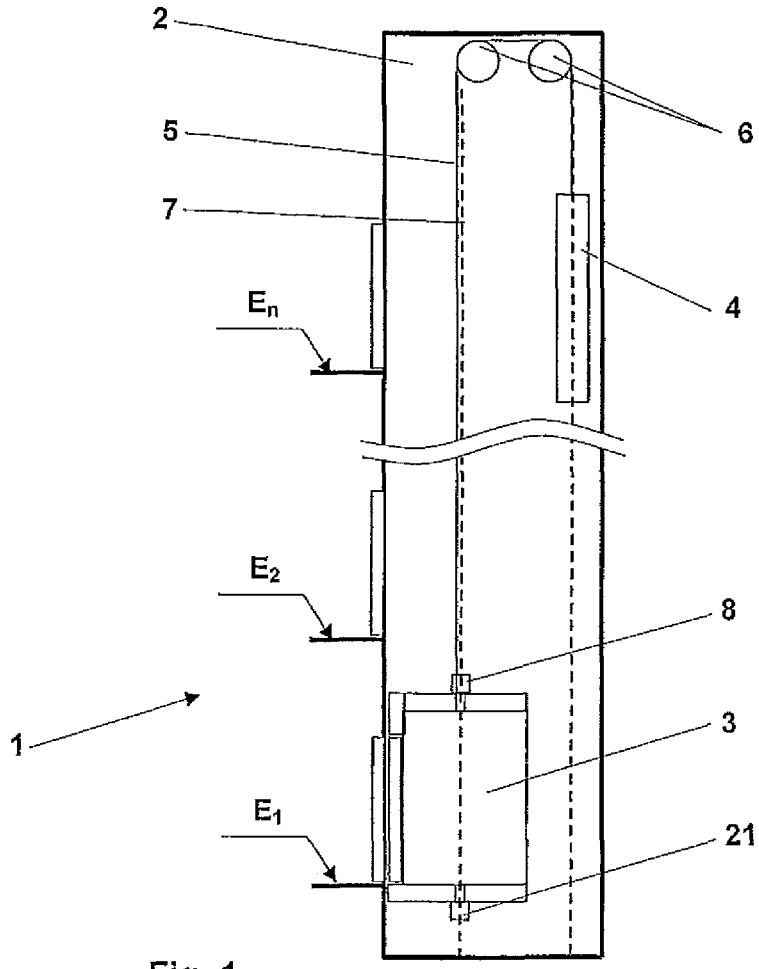
FIG. 1 shows a view of an elevator installation with elevator car and brake equipment arranged above the elevator car.
Figure 7:
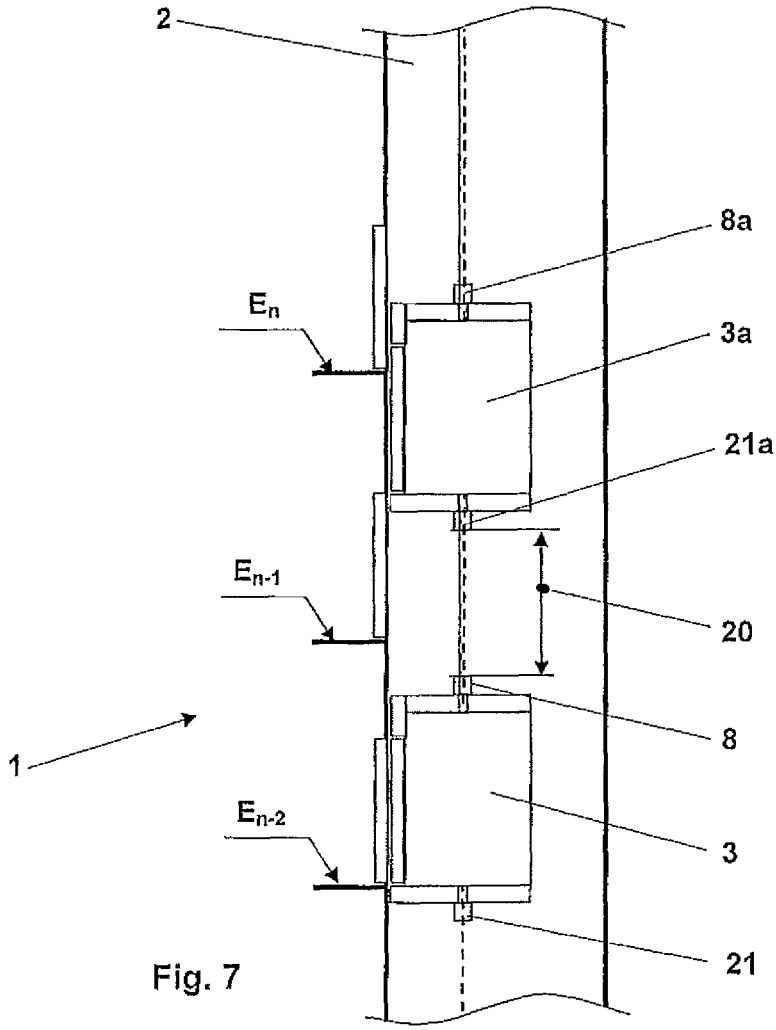

Parts with the same effect are provided in all figures with the same reference numerals. One possible overall arrangement of the elevator installation 1 is illustrated in FIG. 1. The illustrated elevator installation 1 includes an elevator car 3 for reception of goods or persons. The elevator car 3 is movable along a guide rail 7. The elevator installation 1 is installed in a building and the elevator car 3 transports goods or persons from and to different floors E1 . . . EN of this building. In an embodiment illustrated here the elevator installation 1 is installed in an elevator shaft 2 of the building and it includes, apart from the elevator car 3, support means 5 which connect the elevator car 3 with a counterweight 4. The elevator car 3 is moved by means of a drive 6 acting on the support means 5. The guide track for guidance of the elevator car 3 is a guide rail 7 which is fixedly arranged in the building or in the travel shaft 2. In the case of several elevator cars 3, 3*a* in one travel shaft 2, as illustrated in FIG. 7, each of the elevator cars 3, 3*a* advantageously has an individual drive system, but they use the same guide track or guide rail 7. The elevator car 3 is equipped with brake equipment 8 which can hold the elevator car 3 at a stopping position and/or can brake and hold the elevator car 3 in the case of fault. The holding position is, in the normal case, a floor stop. The brake equipment, for the purpose of braking, co-operates with a brake rail which in the illustrated example is integrated in the guide rail 7. Moreover, the illustrated elevator car 3 is equipped, according to FIG. 1, with a safety brake device 21 which would brake the elevator car 3 in the case of an extreme excess speed or even a support means failure. In FIG. 7, in an analogous embodiment the two elevator cars 3, 3*a* are each provided with respective brake equipment 8, 8*a* arranged above the elevator car 3, 3*a* and a respective safety brake device 21, 21*a* arranged below the elevator car.

Figure 2:
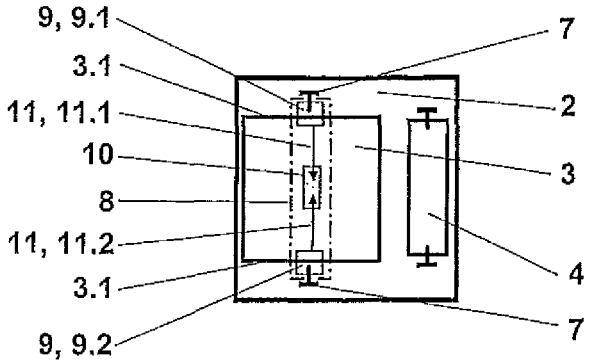
FIG. 2 shows a plan view of the elevator installation according to FIG. 1.

FIG. 2 shows a plan view of the elevator car 3 of the embodiment illustrated in FIG. 1. The brake equipment 8 consists of a first brake unit 9, 9.1 and a second brake unit 9, 9.2. The brake units 9 are arranged at mutually opposite boundary edges 3.1 of the elevator car 3 and act there on the guide rail 7, which at the same time forms the brake rail. In addition, the brake equipment 8 includes an actuating device 10 which is arranged substantially in the middle between the two brake units 9. The actuating device 10 is connected by way of connecting means 11 or a first connecting means 11.1 and a second connecting means 11.2 with the brake units 9 at both sides. Through drawing together the two connecting means 11 the brake units 9 are acted on synchronously with the same force. This means that the actuating device 10 hangs freely substantially in the force direction. Obviously fastening means (not illustrated) are present which prevent turning of the actuating device 10, but at the same time enable a limited displacement, if needed, in the force direction of the connecting means 11. This is necessary to make possible different lengthenings in the connecting means. The connecting means 11 in the illustrated example are pull cables as used, for example, for a Bowden pull. Obviously pull rods with articulated connecting points or also a pull chain could be used instead of pull cables. However, the connecting means is merely to be designed in order to transmit a pulling force to the brake unit 9; it is a pull means.

Figure 3:
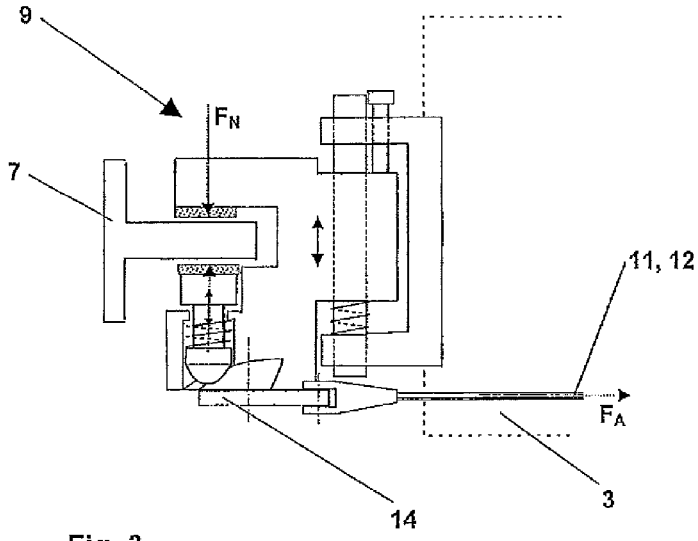
FIG. 3 shows a view of a first embodiment of a brake unit with connecting means.

FIG. 3 shows a possible construction of the brake unit 9. In the example there is shown an unactuated brake which is connected in known mode and manner by way of a floating mounting with an abutment at one side relative to the elevator car 3. The connecting means 11 or the pull cable 12 in the case of actuation adjusts a movable brake lining by way of a force translation lever 14 and thus firmly clamps the guide rail 7. A braking force by means of which the elevator car 3 is braked or held arises through this clamping force or pressing force $F_N$. The brake unit is actuated by the connecting means 11 in force-active manner, i.e. the brake unit is in opened or non-braking position in the absence of an actuator force $F_A$ transmitted by the connecting means 11.

Figure 5A:
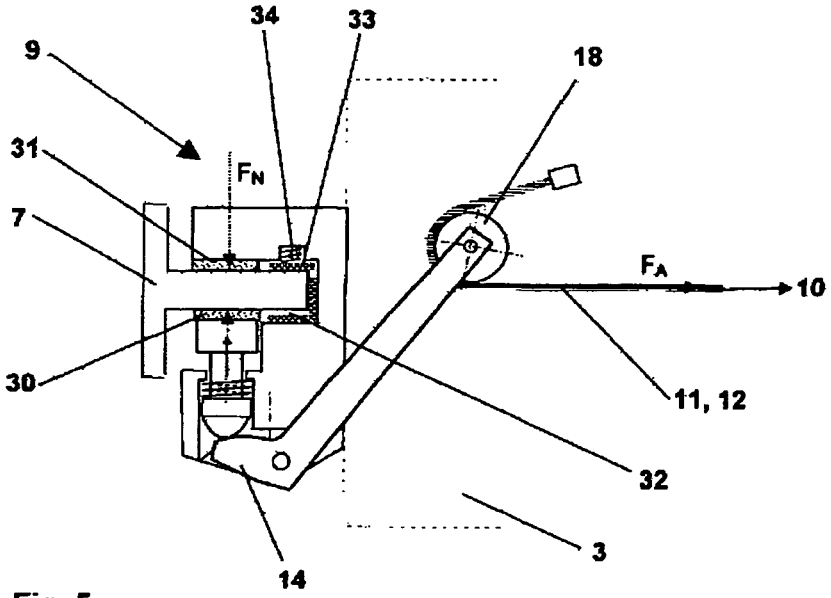
FIG. 5*a* shows a view of another embodiment of a brake unit with connecting means, illustrated in an actuated position.
Figure 5:
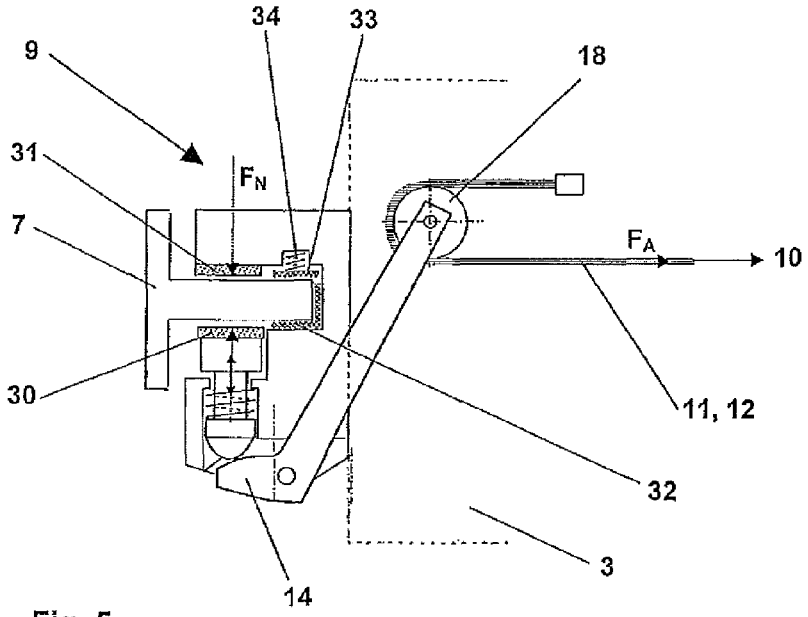
FIG. 5 shows a view of another embodiment of a brake unit with connecting means.

FIG. 5 shows another embodiment of the brake unit 9. In this example there is shown a brake which is similarly unactuated and which is fixedly connected with the elevator car 3. The connecting means 11 or the pull cable 12 in the case of actuation adjust the movable brake lining by way of a force translation lever 14 and thus firmly clamp the guide rail 7. A braking force by means of which the elevator car 3 is braked or held arises through this pressing force $F_N$. Mechanical force translations of, for example, 1:10 can be achieved with a translation lever 14 of that kind. In addition, in the illustrated example there is provided a further force translation in that the pull cable 12 is slung by way of a block-and-tackle in the ratio 2:1. An actuator force $F_A$ can consequently be amplified by the factor 2×10 by this overall arrangement. The resulting pressing force $F_N$ thus amounts to twenty times the value of the actuator force, i.e. $F_N=20\times F_A$. The amplification factor is by way of example. Optimum amplifications with consideration of an actuating travel can obviously be determined with use of different lever geometries, gate guide shapes, eccentric press mechanisms or calotte discs as well as variability of the deflection arrangement in the connecting means. In this example the brake unit 9 at the same time takes over guidance of the elevator car 3, at least in the region of the brake unit 9. The brake unit 9 is, as illustrated, fixedly connected with the elevator car 3. A fixed guide lining 32 is arranged on the side of the movable or adjustable brake plate 30. This fixed guide lining 32 in normal operation takes over the usual guidance forces. A resiliently mounted guide lining 33 is arranged on the side of the fixed brake lining 31. A resilient mounting 34 of the guide lining 33 is dimensioned in such a manner that usual guidance forces such as are given in normal operation do not cause compression of the resilient guide lining 33.

If the brake unit 9 is now adjusted, i.e. the movable brake lining 30 is adjusted by means of the actuator force $F_A$, the movable brake lining 30 advances relative to the fixed guide lining 32 and subsequently presses the resilient guide lining 33 at the opposite side back against the resilient mounting 34 until the fixed brake lining 31 bears against the guide rail 7 and can then develop its braking effect. This form of embodiment of the mounting is not obligatory. Other embodiments, such as the floating mounting illustrated in FIG. 3, are equally usable.

Figure 4:
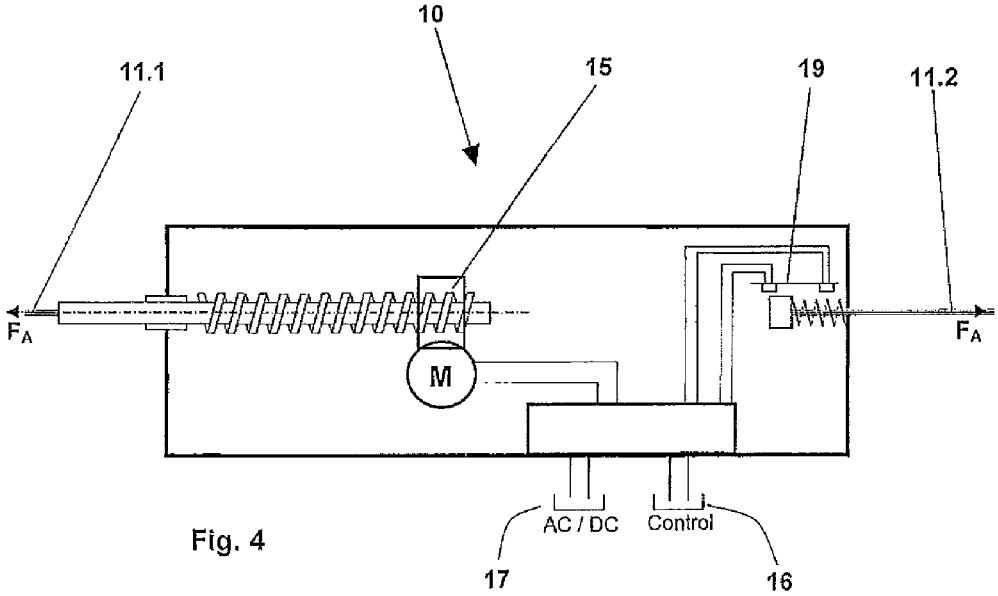
FIG. 4 shows a view of a first embodiment of an actuating device with connecting means.
Figure 3A:
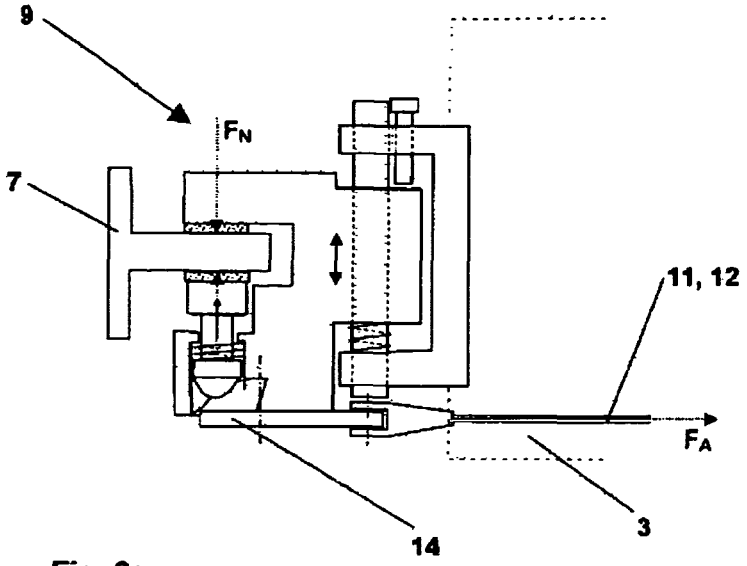
FIG. 3*a* shows a view of a first embodiment of a brake unit with connecting means, illustrated in an actuated position.
Figure 3B:
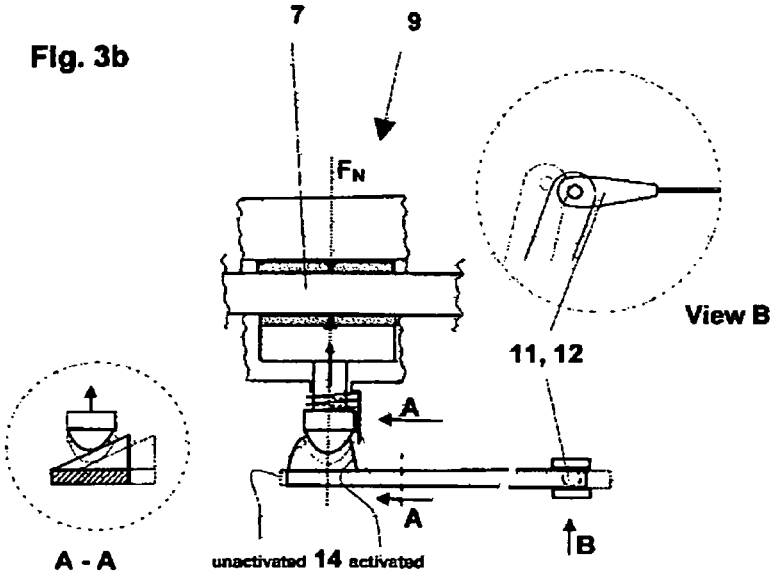
FIG. 3*b* shows a view of a first embodiment of a brake unit with connecting means, with side views further illustrating a force translation lever, with the dotted line indicating an unactivated or open setting and the solid line indicating an activated or use setting.

FIG. 4 shows an example of an actuating device 10. The first connecting means 11.1 is connected by means of a tensioning device 15, consisting of a spindle and spindle motor, which can draw the first connecting means 11.1 into the actuating device 10. The second connecting means 11.2 at the opposite side is connected by way of a force measuring device 19 with the actuating device 10. A tensioning force $F_A$ generated by the tensioning device 15 is thus symmetrically transmitted by way of the connecting means 11.1, 11.2 to the brake units 9 (not illustrated in FIG. 4). The tensioning device 15 is controlled by means of the sensor or the force measuring device 19, i.e. when the actuator force $F_A$ builds up the tensioning device 15 is switched off on attainment of a set force point, whereby the actuator force achieved is maintained and on removal of the actuator force the tension is decreased until the corresponding force-free information is measured. The illustrated tensioning device 15 is selected in such a manner that in case of failure of an energy supply 10, which can be a mains voltage source AC or a direct voltage source DC, or in the case of failure of a control signal 'control' a currently achieved actuator force $F_A$ is maintained. This is achieved by, for example, appropriate selection of a spindle pitch.

Figure 6:
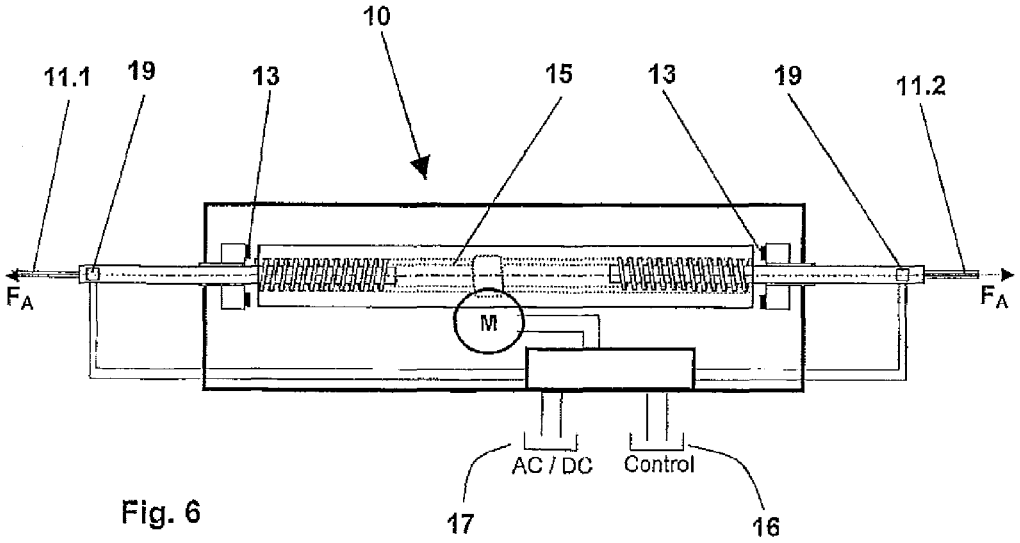
FIG. 6 shows a view of another embodiment of an actuating device with connecting means and FIG. 7 shows a view of an elevator installation with several elevator cars in a travel shaft and items of brake equipment arranged above the elevator cars.

FIG. 6 shows another example of an actuating device 10. The first and second connecting means 11.1, 11.2 are connected together by means of a tensioning device 15 consisting of a spindle with threads of opposite sense. Through actuation of the spindle by means of a spindle motor the two connecting means 11 are mutually tightened. The instantaneous actuator force $F_A$ can be measured by means of force sensors 19 and the tensioning device 15 correspondingly controlled. In this embodiment the spindle in the case of failure of one of the connecting means 11 hits against one of the limiting means 13 and the actuator force can, nevertheless, be built up in the remaining connecting means 11. Since the actuator force $F_A$ is measured in both connecting means 11 a fault of that kind can be rapidly detected and appropriate repairs initiated. An actuating device of that kind can typically produce an actuator force $F_A$ of approximately 1,500 N. In the case of a force amplification in the force translation means 14 by the factor ten there thus results, in a direct coupling of the connecting means 11 with the brake unit 9 as illustrated in FIG. 3, a pressing force $F_N$ of approximately 15,000 N. With use of two brake units 9 as apparent in FIG. 1 and an assumed coefficient of friction of 0.3, a total holding force of $2\times2\times15{,}000\times0.3=18{,}000$ N correspondingly results. With use of a safety factor of 2 for holding an elevator car laden to 125% and an equilibrium of 50% this thus corresponds with an elevator car with a permissible transport load of approximately 1,230 kg. This explanation is by way of example. Other safety factors, forms of equilibrium as well as other designs of actuating devices 10, force translation means 14 or brake units 9, etc., are obviously possible.

FIG. 7 shows a use of the invention in an elevator installation with several elevator cars 3 in one travel shaft 2. Each of the elevator cars 3, 3*a* is equipped with brake equipment 8, 8*a*. This brake equipment 8, 8*a* is used inter alia for maintaining a sufficient safety spacing 20 between two elevator cars 3, 3*a*. If, for example, it is established by a spacing detector that the spacing between two elevator cars unexpectedly rapidly reduces the brake equipment 8, 8*a* of the trailing elevator car 3, 3*a* is activated and thus a collision prevented. In addition, the brake equipment is activated, i.e. actuated, at a stop of one of the elevator cars 3, 3*a* at one of the floors E. A swinging or slipping away of the elevator car 3, 3*a* during loading is thus prevented.

As apparent in FIGS. 1 and 7 the existing safety brake device 21 is usually also present. The design criteria for the brake equipment 8 are thus reduced. The brake equipment 8 can obviously also be used as a safety brake, for example with use of redundant energy supplies and controls.

With knowledge of the present invention the elevator expert can change the set forms and arrangements in various ways. For example, the illustrated tensioning device 15 can also be constructed with, instead of spindle drives, linear motors or spool motors or similar or the connecting means 11 can be deflected relative to the actuating device 10.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator car with brake equipment, which is arranged in a region of the elevator car, for holding and braking the same, comprising:

a brake unit having at least one brake plate which can co-operate with a brake rail, the brake unit having a use setting when the brake plate of the brake unit co-operates with and contacts the brake rail and having an open setting when the brake plate of the brake unit does not co-operate with and does not contact the brake rail;

an actuating device which produces an actuator force $F_A$; and a flexible connecting means which connects the actuating device with the brake unit in a tension force-active manner for transmission of the actuator force $F_A$, wherein the actuator force $F_A$ generated in the actuating device is applied to a force translation lever that produces a pressing force $F_N$ between the brake plate of the brake unit and the brake rail, which pressing force $F_N$ is directly dependent on the actuator force $F_A$, whereby when no actuator force $F_A$ is applied to the brake unit the brake unit is in the open setting, and wherein the connecting means is a pull means, by means of which merely tension force can be transmitted.

2. The elevator car according to claim 1 wherein the brake equipment comprises at least two brake units which advantageously are arranged at opposite boundary edges of the elevator car and which each co-operate with a respective brake rail and that the actuating device, which generates the actuator force $F_A$ for actuation of the brake units, is arranged substantially centrally in the middle between two brake units, wherein a first connecting means is connected with a first brake unit and a second connecting means is connected with a second brake unit.

3. The elevator car according to claim 2 wherein a position of the actuating device is defined substantially by an equilibrium of the first and second connecting means, wherein on failure of one of the connecting means a limiting means maintains the actuator force $F_A$ in the remaining connecting means.

4. The elevator car according to claim 2 wherein the actuating device includes a tensioning device which draws together the first and second connecting means for producing the actuator force $F_A$ or relaxes the first and second connecting means, wherein the tensioning device in the absence of a control signal or a supply energy maintains the produced actuator force $F_A$.

5. The elevator car according to claim 4 wherein the tensioning device comprises a spindle transmission which can draw together the two connecting means.

6. The elevator car according to claim 1 wherein the force translation lever converts the actuator force $F_A$ transmitted by the connecting means into the pressing force $F_N$ and simultaneously produces amplification of this pressing force $F_N$.

7. The elevator car according to claim 1 wherein the connecting means is suspended by a block-and-tackle and the actuator force $F_A$ transmitted by the connecting means to the brake unit is amplified in correspondence with a slinging factor of the block-and-tackle.

8. The elevator car according to claim 1 wherein the actuating device includes a sensor for detecting an instantaneous value of the actuator force $F_A$ and the actuating device uses the instantaneous value of the actuator force for controlling, regulating and monitoring the actuator force.

9. The elevator car according to claim 1 wherein the elevator car further includes a safety brake device.

10. The elevator car according to claim 1 wherein the connecting means is a pull cable, a pull rod, a pull chain or a Bowden pull, wherein the connecting means can transmit merely tension force.

11. An elevator installation with at least one elevator car according to claim 1 wherein the elevator car is movable in a travel shaft.

12. The elevator installation according to claim 11 wherein a plurality of elevator cars is installed in a common travel shaft and the items of brake equipment of these elevator cars are used for ensuring a sufficient safety spacing between these elevator cars.

13. A brake equipment, which is arranged in a region of an elevator car, for holding and braking the elevator car, the brake equipment comprising:

a brake unit having at least one brake plate which can co-operate with a brake rail, the brake unit having a use setting when the brake plate of the brake unit co-operates and contacts with the brake rail and having an open setting when the brake plate of the brake unit does not co-operate with and does not contact the brake rail;

an actuating device for generating an actuator force $F_A$; and a flexible connecting means which connects the actuating device with the brake unit in tension force-active manner for transmission of the actuator force $F_A$, wherein a pressing force $F_N$ directly dependent on the actuator force $F_A$ is produced by the actuator force $F_A$ in the brake unit when applied to a force translation lever and, further, a corresponding braking force between the brake plate of the brake unit and the brake rail is produced by the pressing force $F_N$, and wherein the brake unit in unloaded setting when the connecting means is without tension and accordingly no actuator force $F_A$ is applied to the brake unit is moved into the open setting and a pull means, by means of which merely tension force can be transmitted, is used as connecting means.

* * * * *